US005832768A

United States Patent [19]

Yano

[11] Patent Number: 5,832,768

[45] Date of Patent: Nov. 10, 1998

[54] DIE ASSEMBLY FOR EXTRUDING HOLLOW ARTICLES

[75] Inventor: Sadahide Yano, Osaka, Japan

[73] Assignee: Yugen Kaisha Yano Engineering, Osaka, Japan

[21] Appl. No.: 806,403

[22] Filed: Feb. 26, 1997

Related U.S. Application Data

[63] Continuation of Ser. No. 358,151, Dec. 16, 1994, abandoned.

[51] Int. Cl.[6] ..... B21C 25/04

[52] U.S. Cl. ..... 72/269; 72/261

[58] Field of Search ..... 72/264, 269, 253.1, 72/260, 478, 261; 29/447

[56] References Cited

U.S. PATENT DOCUMENTS

| | | | |
|---|---|---|---|
| 2,651,411 | 9/1953 | Bennett . | |
| 2,811,253 | 10/1957 | Schieren . | |
| 4,697,325 | 10/1987 | Kamigaito et al. | 29/447 |
| 5,131,253 | 7/1992 | Hopkins | 72/269 |

FOREIGN PATENT DOCUMENTS

| | | | |
|---|---|---|---|
| 0398747 | 11/1990 | European Pat. Off. | 72/269 |
| 0220614 | 1/1990 | Japan | 72/269 |
| 0466217 | 3/1992 | Japan | 72/269 |
| 0615347 | 1/1994 | Japan | 72/269 |
| 400 063 | 7/1962 | Switzerland . | |

OTHER PUBLICATIONS

Patent Abstracts of Japan, vol. 17, No. 365, (M–1422), Jul. 9, 1993 of JP 5057337 (Showa Alum. Corp.), Mar. 9, 1993.

*Primary Examiner*—Lowell A. Larson
*Assistant Examiner*—Ed Tolan
*Attorney, Agent, or Firm*—Armstrong, Westerman, Hattori, McLeland & Naughton

[57] ABSTRACT

A male die (2) is composed of an annular base (7), a bridge (8) and a forming lug (9), and a female die (3) tightly fits in the annular base (7) of the corresponding male die (2). A distance between a forming slit (28) and a location where the male die (2) engages with the female die (3) is decreased such that the misalignment of the forming lug (9) with a forming hole (26) is prevented from occurring during an extrusion process. The male die in combination of the female die enables the production of hollow articles of a high dimensional precision free of any unevenness in wall thickness.

7 Claims, 15 Drawing Sheets

DIE ASSEMBLY FOR EXTRUDING HOLLOW ARTICLES

This application is a continuation of application Ser. No. 08/358,151 filed Dec. 16, 1994, now abandoned.

BACKGROUND OF THE INVENTION

1. Field of the Invention

The present invention relates to a die assembly for use to extrude hollow articles of a metal such as aluminum.

2. Description of the Prior Art

A prior art port-hole die as shown in FIGS. 15A and 15B has widely been used to extrude aluminum hollow articles. This die assembly usually consists of a male die 71 and a female die 72 combined therewith. The male die 71 comprises a generally disc-shaped base 73 and a central forming lug 74 protruding forward and centrally thereof. Separate port holes 75 penetrating the base 73 in a fore and aft direction are arranged around the forming lug 74. On the other hand, the female die 72 has likewise a disc-shaped base 76 and a central forming hole 77 penetrating the base fore and aft. Further, the male die base 73 has along its periphery an annular recess 78 formed at front surface, and the female die base 76 also has along its periphery an annular protrusion 79 formed at rear surface. The male and female dies 71 and 72 are aligned with each other by fitting the annular protrusion 79 in the annular recess 78. A forming annular slit 80 thus defined between the forming lug 74 and the forming hole 77 is of a configuration corresponding to the cross-sectional shape of the hollow articles to be extruded.

However, those prior art die assemblies have sometimes failed to ensure a required dimensional preciseness to the extruded hollow articles and protect them from any uneven wall thickness.

Such a drawback may have been caused by the alignment of the male die 71 with the female die 72 in the described manner. Their bases 73 and 76 have the outer peripheral edges, where their annular recess 79 and protrusion 78 engage one another remote from the central forming annular slit 80. A pressure loaded to the dies by the material which is being extruded may inevitably cause an irregular strain or distortion of the die bases, possibly resulting in a variation of distance between the peripheries of the forming lug 74 and hole 77.

The material to be extruded from the prior art die assembly has to flow through the port holes 75 penetrating the male die base 73. Accordingly, a higher pressure must be applied to the material to overcome a strong frictional resistance.

OBJECTS OF THE INVENTION

An object of the present invention made in view of such drawbacks is therefore to provide a die assembly adapted to extrude hollow articles of a higher accuracy in dimension and free from any uneven wall thickness.

Other objects and advantages of the present invention will become apparent from its embodiments described below. The embodiments setting forth some preferable modes are not intended to delimit the invention, but can be modified within the spirit and scope thereof.

SUMMARY OF THE INVENTION

A die assembly provided herein to extrude hollow articles of an extrudable material comprises a male die for defining a hollow space through each article and a female die for defining an outer periphery of each article, wherein the male die is composed of an annular base, a forming lug and a bridge for securing the forming lug to the annular base, and wherein the female die having a forming hole is shaped to tightly fit in a receiving recess formed in the male die.

The bridge is usually made integral with the annular base, and protrudes rearwardly from a rear face thereof, reversely to the flow of the extrudable material.

The male and female dies are preferably made of an appropriate hard material such as a hard metal (viz. cemented carbide) and ceramics, in order to prevent their undesirable distortion during an extrusion process.

A forming slit defined between the male die and the female die is desirably located at or proximate the rear face of the annular base.

The female die may be a short columnar and integral piece.

The forming lug of the male die may be a core such that this core and the bridge are discrete members mating one another, and an aperture may penetrate the bridge in a fore and aft direction so as to receive the core in such a state that a forming end thereof protrudes forwardly of the bridge, with the core capable of being removed therefrom in a rearward direction. In combination with the male die of this type, the female die in one mode of the invention may comprise a bearing tip made of a thin plate. This plate of a thickness substantially equal to a length of a bearing region of the forming hole may be supported at its periphery and rear surface by a tip holder composed of mold members.

In a further mode of the present invention, the die assembly comprises a plurality of male dies, a die holder for holding them and a plurality of female dies tightly fittable in annular bases of the respective male dies, wherein each male die is composed of the annular base, a forming lug and a bridge to secure the forming lug in the annular base, and wherein the die holder has apertures in which the respective male dies fit to be held in place.

In this mode, the die assembly may additionally comprise a flow regulating block disposed in rear of the die holder, viz. upstream of the flow of extrudable material. This block may have discrete bridging portions in which through holes are formed for flowing the extrudable material, and each bridging portion is located preferably a small distance behind the corresponding bridge of the male die.

DETAILED DESCRIPTION OF THE PREFERRED EMBODIMENT

Die assemblies in some embodiments of the invention will now be described.

Figure 14:
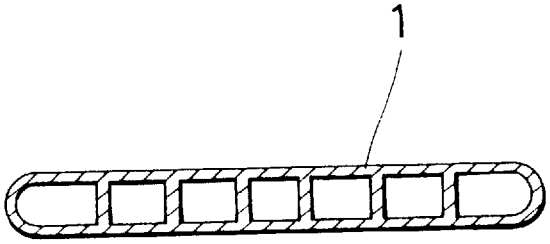
FIG. 14 is a cross section of a hollow article to be extruded using any of the preceding die assemblies.
Figure 15A:
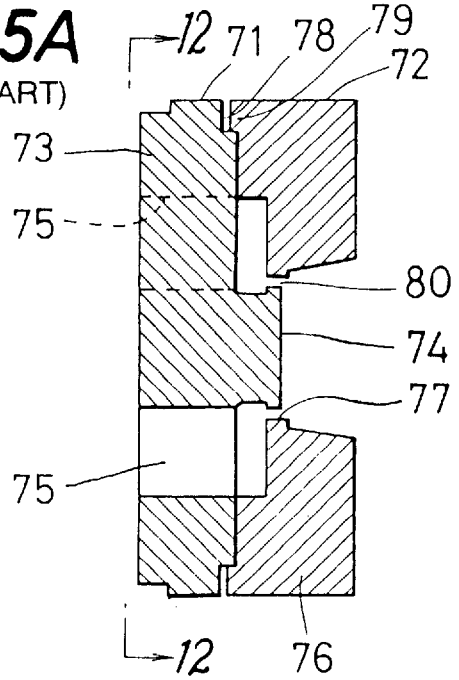
FIG.15A (PRIOR ART)
FIG. 15A is a cross section of a prior art apparatus.
Figure 15B:
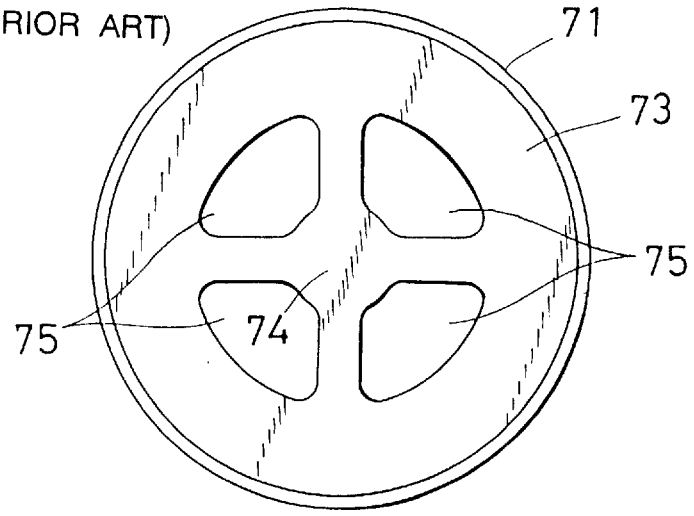
FIG.15B (PRIOR ART)
FIG. 15B is a rear elevation of the apparatus seen from the line 12—12 in FIG. 15A.

In each embodiment, a hollow article to be extruded by any of the die assemblies is a flat and perforated aluminum tube 1. This tube shown in FIG. 14 is used to construct a heat exchanger for use in air conditioners. Each die assembly in the embodiments is adapted to extrude in harmony a plurality of such tubes.

It will however be understood that the articles produced by extrusion may not necessarily be such exemplified tubes 1, but be those of any other shape or for any other use. The raw material to be extruded is not delimited to aluminum, but may be any one of other extrudable metals. Further, the die assembly may alternatively be constructed such that only one hollow and elongate article can be extruded at a time.

Figure 1:
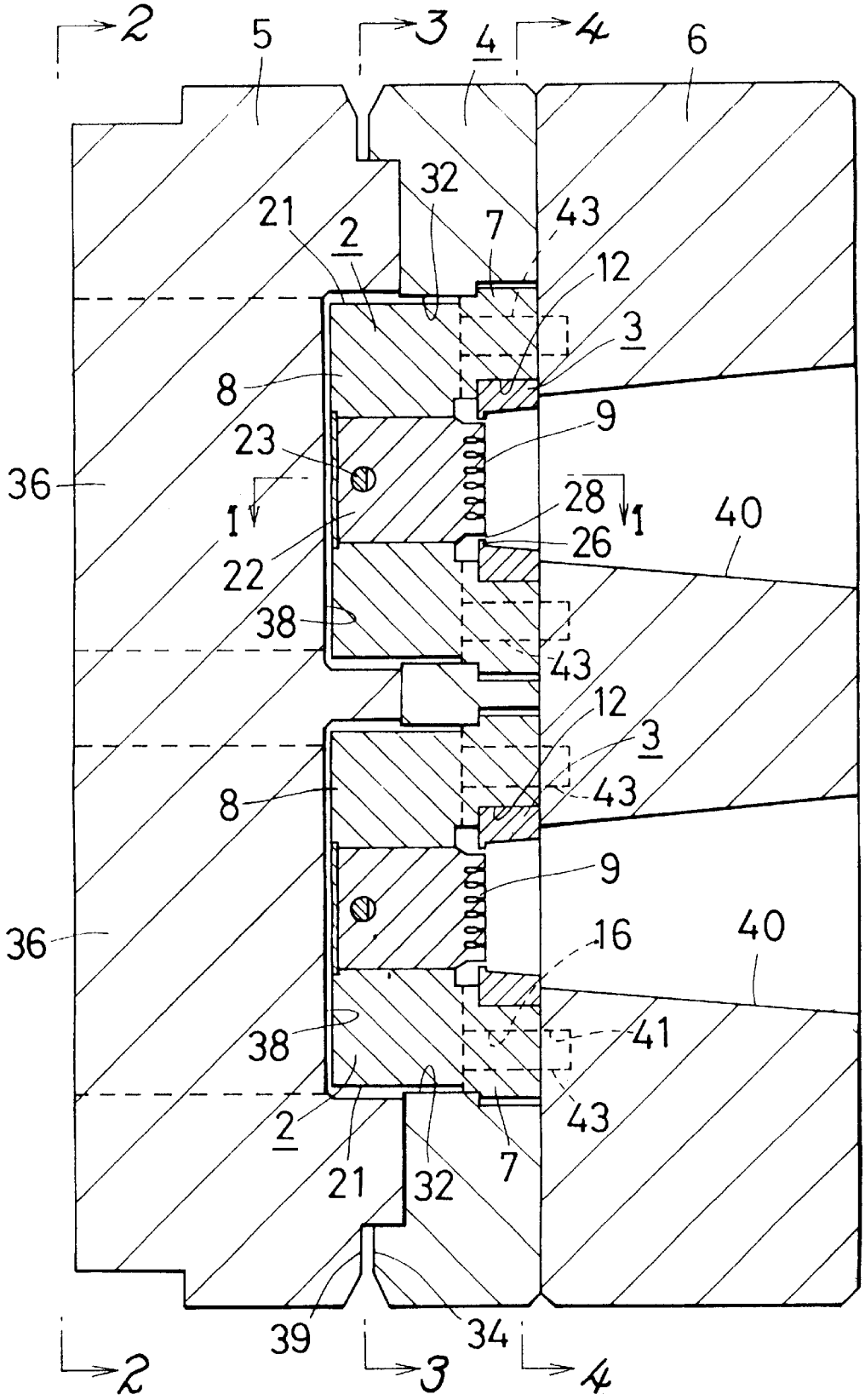
FIG. 1 shows a die assembly for extruding hollow articles, the die assembly being provided in an embodiment and shown entirely in cross section.
Figure 2:
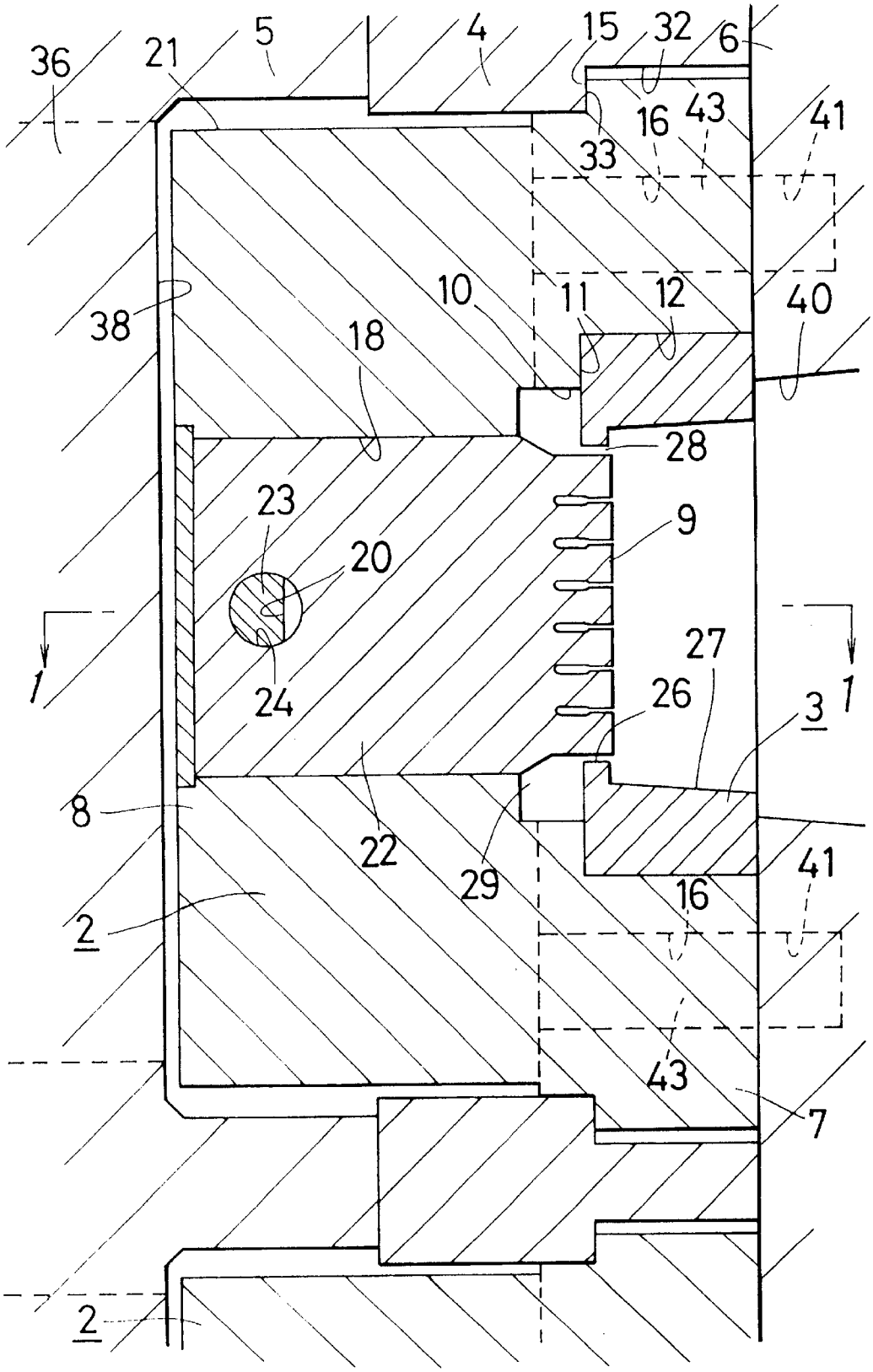
FIG. 2 is an enlarged cross section of one male with combined with one female die included in the die assembly.

FIGS. 1 to 7 show an extrusion die assembly in a first embodiment. As seen in FIG. 1, this die assembly comprises two male dies 2, two female dies 3, a die holder 4, a flow regulating block 5 and a back-up block 6.

Each male die 2 serves to form at least one bores extending through the extrudate, and is composed of an annular base 7, a bridge 8 and a forming lug 9 as shown in FIGS. 2 to 5.

The annular base 7 is made of an extremely hard material such as a hard metal or ceramics. An axial bore 10 penetrating the annular base has an annular and step-shaped shoulder 11. This shoulder faces towards the female die and is located upstream of an extruded material flow. The bore has a forward and large-diameter region in front of the shoulder 11, and this region serves as a recess 12 for receiving the female die.

Key ways 13 are formed in axial direction of the recess 12 and in an inner periphery thereof, so that the female die 3 can be set at a predetermined angular position within said recess. An annular step 15 is formed along a rear peripheral edge of the base 7. Four openings 16 are formed through the annular base at regular angular intervals so as to receive four positioning knockout pins.

The bridge 8 for receiving and holding the forming lug 9 at a correct position is also made of the same hard material (viz. hard metal or ceramics) as the annular base 7, which is integral with this bridge. The bridge 8 protrudes rearwardly from the annular base 7 and across the axial bore 10. A middle portion of this bridge has a frontal end located behind the annular shoulder 11 of the axial bore 10, with respect to the extruding direction.

An aperture 18 penetrating the bridge 8 in a fore and aft direction is slit-shaped to receive and hold the forming lug 9. Shallow grooves 19 are formed in opposite side surfaces of the aperture, to extend forwardly from its rear end to a middle depth so as terminate as small stopping walls 20 bearing against the inserted knockout pin.

Figure 3:
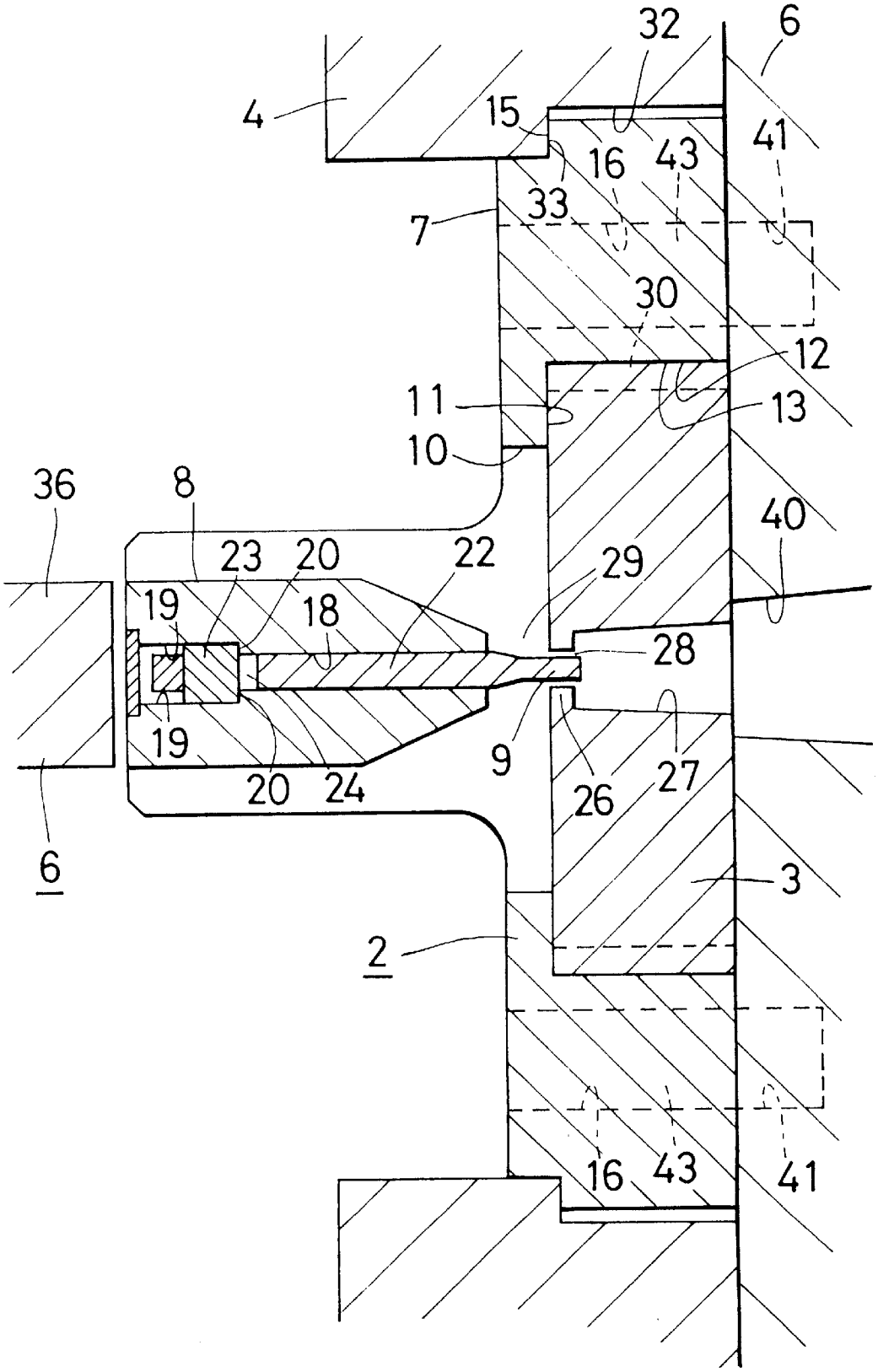
FIG. 3 is a cross section taken along the line 1—1 in FIGS. 1 and 2.
Figure 4:
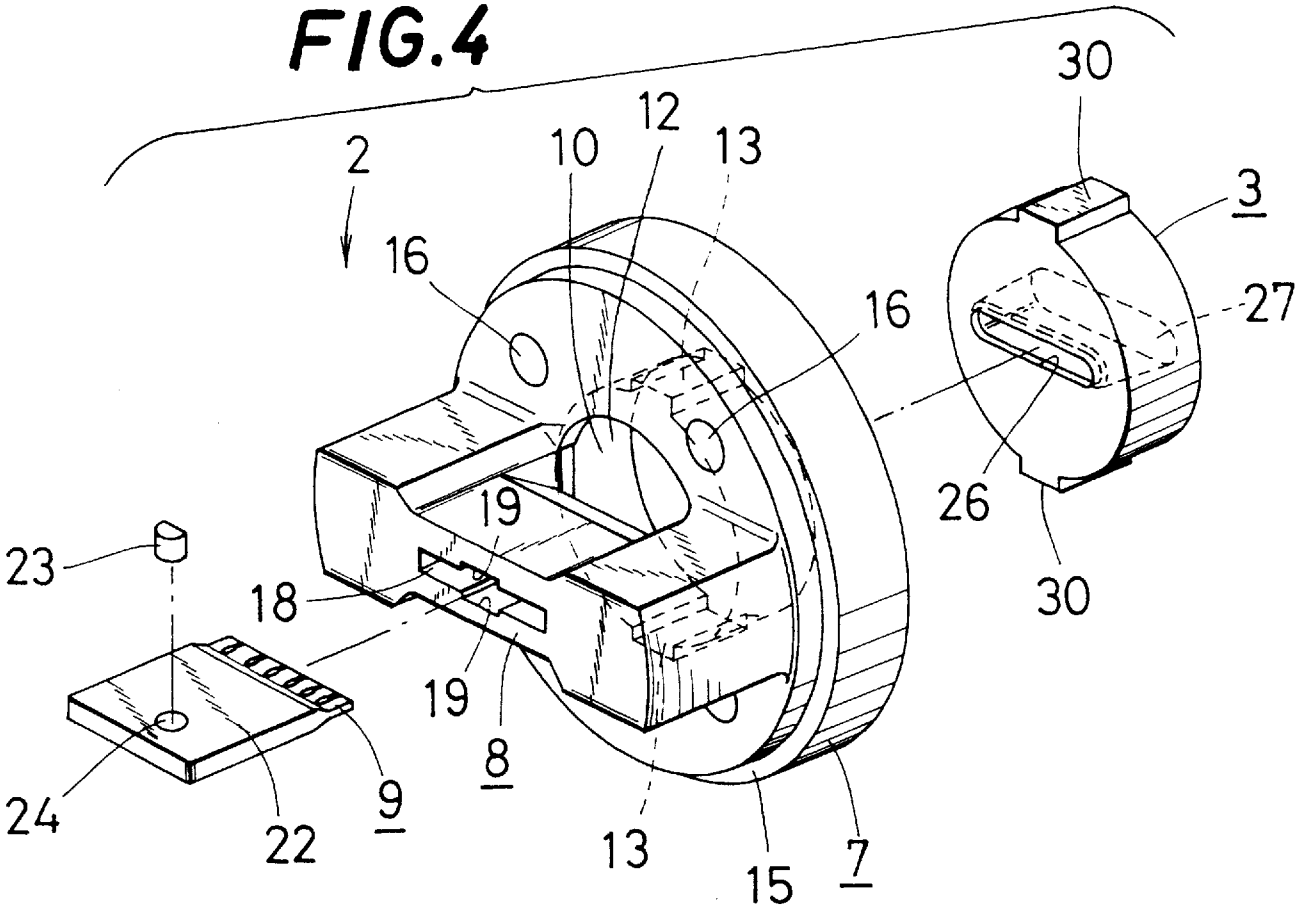
FIG. 4 is a perspective view of the male die disassembled from the female die, seen from an upstream side thereof with respect to the flow of extruded material.
Figure 5:
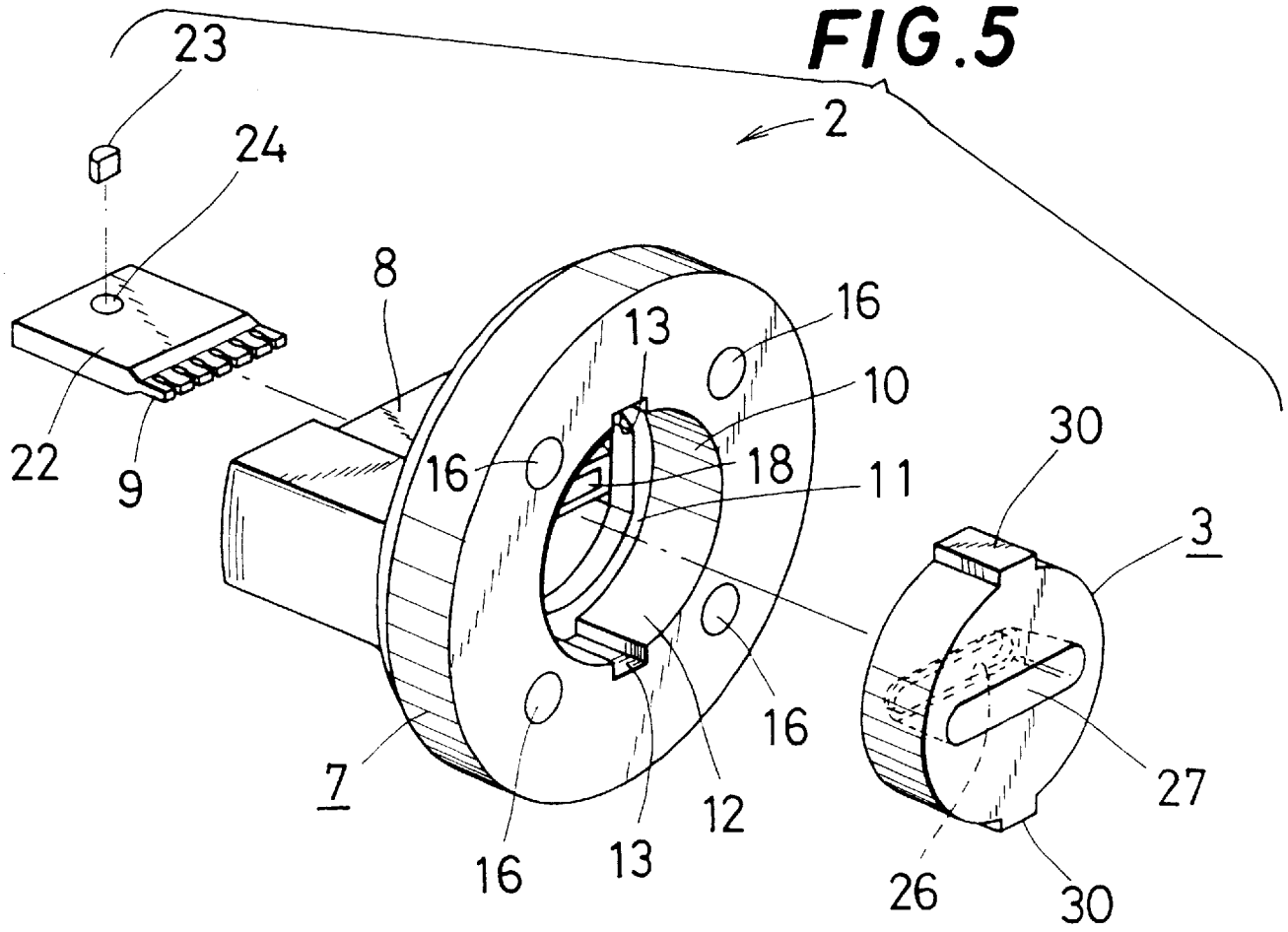
FIG. 5 is similarly a perspective view of the male die disassembled from the female die, seen from a down-stream side thereof.
Figure 6A:
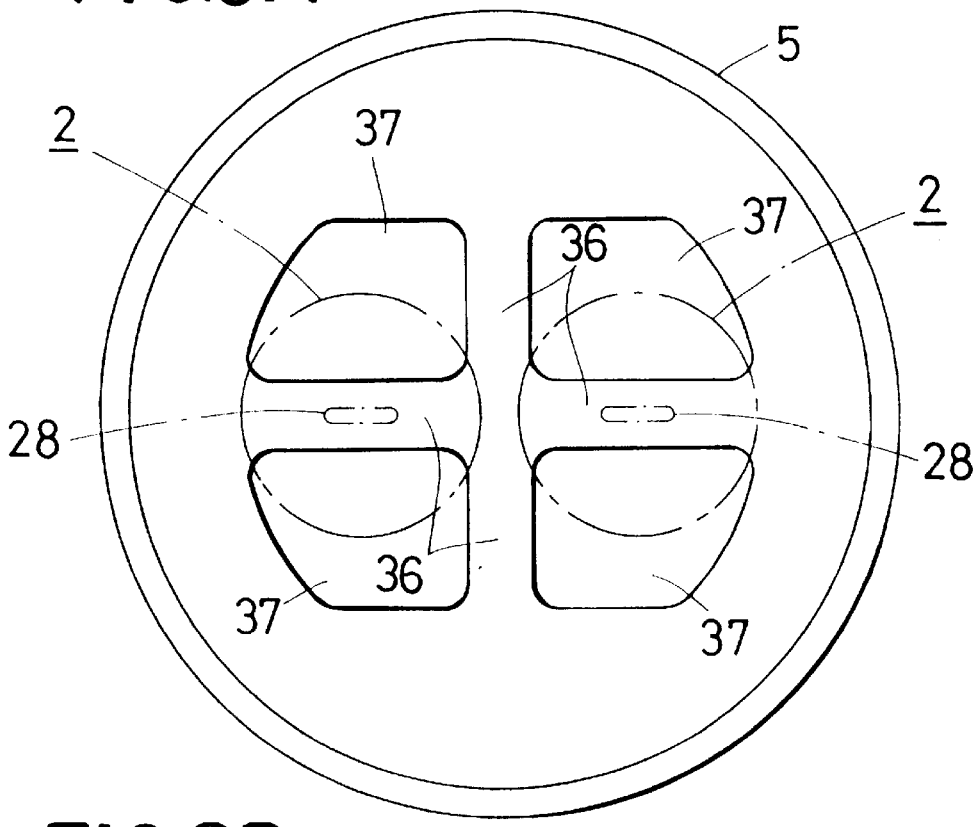
FIG. 6A is a rear elevation of the die assembly, seen from the line 2—2 in FIG. 1.
Figure 6B:
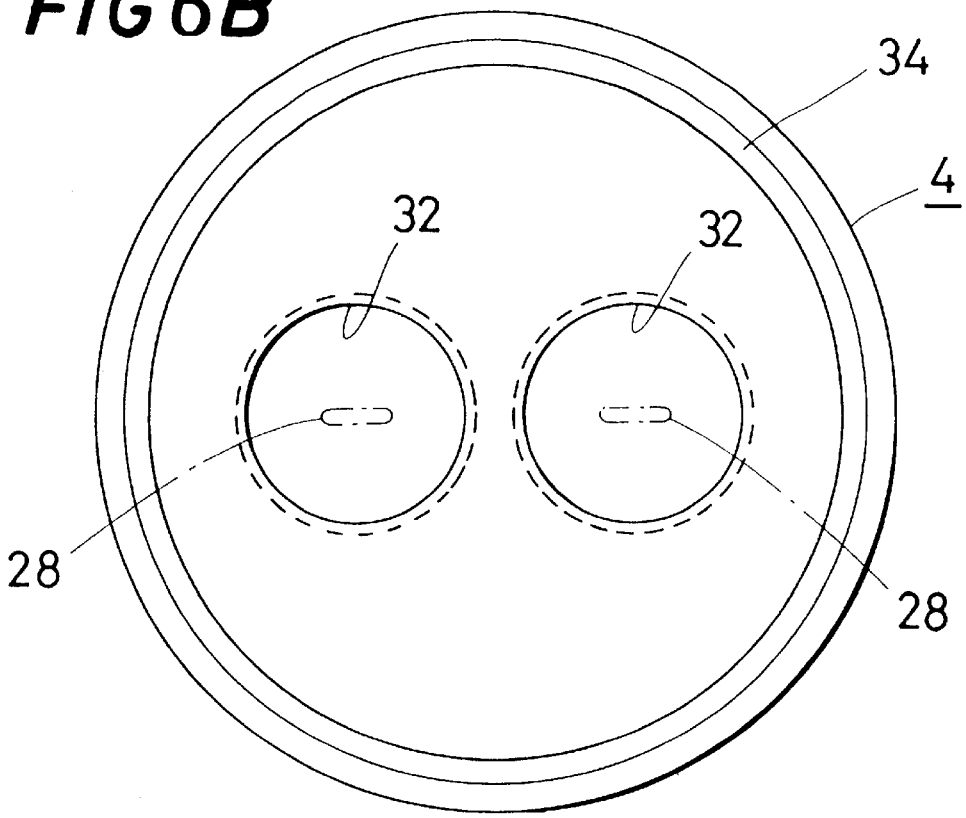
FIG. 6B is a crossing elevation of the die assembly, seen from the line 3—3 in FIG. 1.
Figure 7:
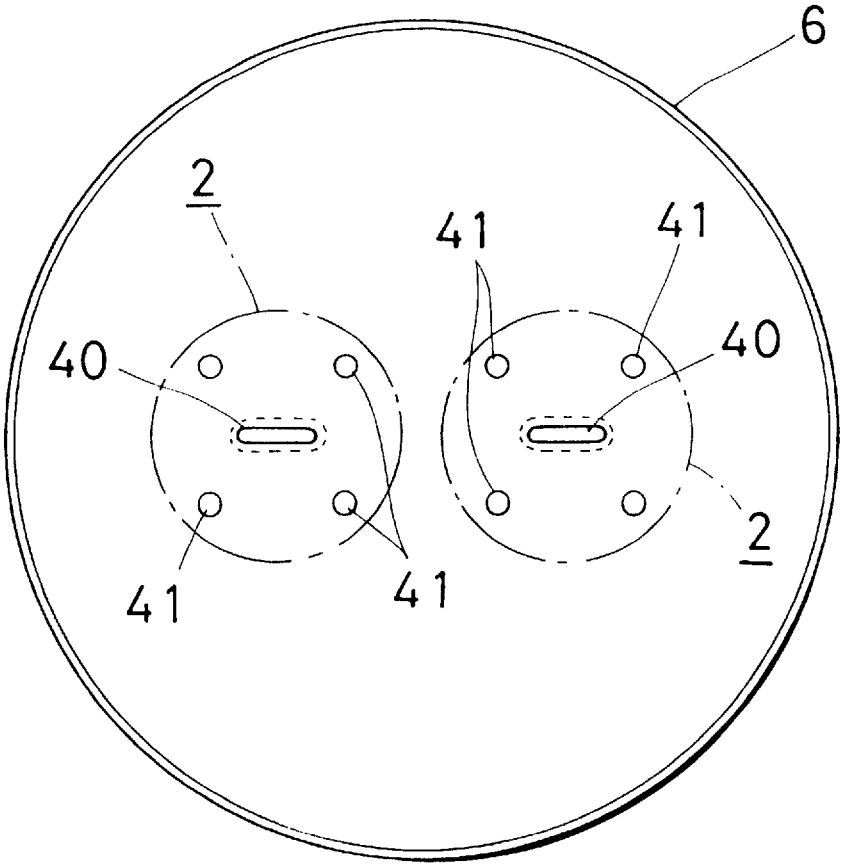
FIG. 7 is another crossing elevation of said die assembly, seen from the line 4—4 in FIG. 1.

The middle portion of the bridge 8 has a forward end chamfered as shown in FIG. 3. The thus reduced thickness of the forward end allows to the extruded material to smoothly pass by said forward end of the middle portion.

A core 22 formed integral with the forming lug 9 cooperates with a supporting pin 23 to position this lug at its correct position within the male die 2.

The core 22 shaped as a generally square plate serving to form the hollow space in the tube 1 is made of a hard material such as a hard metal or ceramics. A forward extremity of the core is the forming lug 9 of a comb-like shape. A hole 24 formed transversely through a portion near a rear end of the core is round to receive the supporting pin.

The supporting pin 23 functioning to position the core 22 in the bridge 8 is also made of a hard material such as a hard metal or ceramics. This pin 23 is inserted in the transverse hole 24, such that opposite ends of said pin jut from the side surfaces of core. When the core 22 is inserted into the aperture 18 of the bridge 8 from its rear end, the opposite ends of the supporting pin 23 will come into contact with the small stopping walls 20 as the foremost ends of the shallow grooves 19 formed in the aperture 18. In this manner, the core 22 is placed in the bridge 8 in such a state that an operator can rearwardly pull the core out of the bridge 8. In this state of the forming lug 9 as the forward extremity of the core 22, this lug juts forwardly of the forward end of the bridge's middle portion.

The female die 3 for defining the outer periphery of the extruded tube 1 is also made of a hard material such as a hard metal or ceramics. The female die is a short and integral columnar piece, and the forming hole pierced through and centrally of this female die consists of a bearing portion or region 26 and a relief region 27 communicating therewith and continuing therefrom. The bearing portion 26 is located proximate the rear face of the female die.

The female die 3 is of a length or thickness corresponding to the length of the recess 12 formed through the male die annular base 7 for holding a female die. A diameter of the female die also corresponds to the diameter of the female die receiving recess 12. Thus, the female die 3 is tightly inserted and shrinkage-fitted in said recess 12 so as to be integral with the annular base 7.

The shrinkage-fitted female die 3 has its rear face proximate the bearing portion 26 and supported on the annular shoulder 11. Therefore, the female die is set in place at its correct position relative to the annular base such that the forming lug 9 is disposed in the bearing portion 26. Thus, a forming slit 28 is defined between those lug 9 and portion 26 and near the rear face of the annular base 7.

A fusion chamber 29 behind the forming slit 28 is located upstream of the extrusion flow, so that tributaries thereof that have been separated by the bridge 8 will join one another in this chamber 29, before extruded through the slit.

Keys 30 formed on axially of the female die outer periphery are shaped to fit in the respective key ways 13 of the recess 12, whereby the female die 3 takes a correct angular position relative to the male die 2.

The die holder 4 for holding the two male dies 2 and 2 is a large-diameter disc made of an appropriate steel such as a die steel. Two cylindrical apertures 32 and 32 extend side by side and through the die holder so as to respectively receive the male dies. Annular step 33 formed in each aperture 32 at its middle region does face towards the frontal surface of the die holder. Therefore, each male die 2 will be inserted in the aperture, from its front side towards its rear side, until the annular step 15 of the male die rests on that 33 in the aperture. Tight contact of the former step 15 with the latter 33 ensures an air-tight seal to prevent leakage of the material that is being extruded. In this state of those male dies, the frontal faces of their bases 7 are flush with the frontal face of the die holder 4, while the male die bridges 8 protrude rearwardly of the rear face of said die holder. A circular protrusion 34 is formed rearwardly and along a periphery of the die holder 4, in order that the flow regulating block 5 is aligned therewith.

The flow regulating block 5, which is also a large-diameter disc made of a die steel or the like, serves to regulate the flow of extrudable material fed from a container to the forming slits 28. Bridging portions 36 cross one another to divide a central cavity of this block into four discrete paths 37. A small gap is left between each bridging potion 36 and the corresponding one of the male die bridges 8. Front recesses 38 formed in frontal surface of the flow regulating block 5 tightly receive the male dies 2. With said block 5 disposed behind and secured to the die holder 4, bottoms of the die receiving recesses 38 of the former are spaced a small distance from the rear faces of the bridges 8.

A circular cutout 39 formed at frontal face of and around this block 5 fits on the circular protrusion 34 of the die holder 4, so that said block and holder can readily and exactly be aligned with one another.

The back-up block 6 is likewise made of a die steel or the like, and has relief holes 40 arranged coaxially with the respective forming slits 28. An entrance opening of each relief hole 40 is smaller than the outer periphery of the female die 3. A rear face of this back-up block 6 fixed to the die holder frontal face does support all the frontal faces of male dies 2, female dies 3 and die holder 4, while permitting the extrudable material to flow forwards. Openings 41 are formed around each relief hole 40, in alignment with those 16 of the male dies 2 so that knockout pins 43 each fitted in the opening 41 and the corresponding one 16 can correctly position the male dies on the back-up block.

In the die assembly of the dual type structure described above, the female dies 3 are placed in the respective recesses 12 formed in the male die annular bases 7. Therefore, each female die 3 is in an aligned contact with the corresponding male die 2, at its portion close to the forming slit 28. This feature is advantageous in that any distortion that the extrudable material such as aluminum might cause to male and/or female dies would scarcely result in misalignment of the bearing portion 26 with the forming lug 9. Thus, any intolerable variation in wall thickness will be prevented from being produced in each extruded tube 1.

This advantage may be of benefit particularly to a case wherein a larger number of couples of the male and female dies are equipped in one assembly to render larger its overall size. Contact portions of the coupled male and female dies are always kept close to the forming slit, thereby affording the described advantage.

The female dies respectively inserted in the male dies can be made of a so small size that they can be replaced with new ones at a lower cost, when worn out.

Since the female die 3 is received in the annular base 7 of the male die 2 having the rearwardly projecting bridge 8, and the forming slit 28 is disposed near the rear face of said base, the material being extruded need not to flow though the prior art port holes 75 surrounded by walls. The reduced contact area of the flowing material only with the bridge 8 is effective to lower the pressure required to extrude the material. The extrusion speed as well as the speed at which a solid raw material is forced into the container can now be raised to improve productivity of the tube 1.

The forming slit 28 formed near the rear face of the male die annular base 7 is located at a middle region intermediate the frontal and rear ends of each assembly of male and female dies 2 and 3. Therefore, an error in coaxiality of them is diminished to further improve the dimensional accuracy of extruded hollow articles.

An abraded forming lug 9 and/or bearing portion 26 can easily be taken out of the assembly, for replacement with new ones, by removing the male die together with the female from the die holder 4.

A relatively loose fitting of the male dies 2 in the die holder suffices well to assure a strict alignment of the female die 3 with the male die 2. Therefore, removal of the couple of them is so easy as to facilitate the disassembling and reassembling of the composite die.

The annular steps 15 and 33 of the die holder 4 and each male die 2 bear against each other so tightly that the material being extruded is prevented from leaking outwardly through a gap present between the male die 2 comparatively loosely fitted in the holder 4.

A small clearance intervenes between the bridge 8 of each male die 2 and the corresponding rear bridging portion 36 of flow regulating block 5. The pressure of the material being extruded is thus unlikely to act the rearmost end surface of the bridge. Thus, the bridges 8 are protected from distortion, and the bearing portion 26 of the forming hole will scarcely become offset relative to the forming lug 9. Any intolerable unevenness in wall thickness of the extruded tube 1 is avoided to thereby render it more accurate in dimension and shape.

Figure 8A:
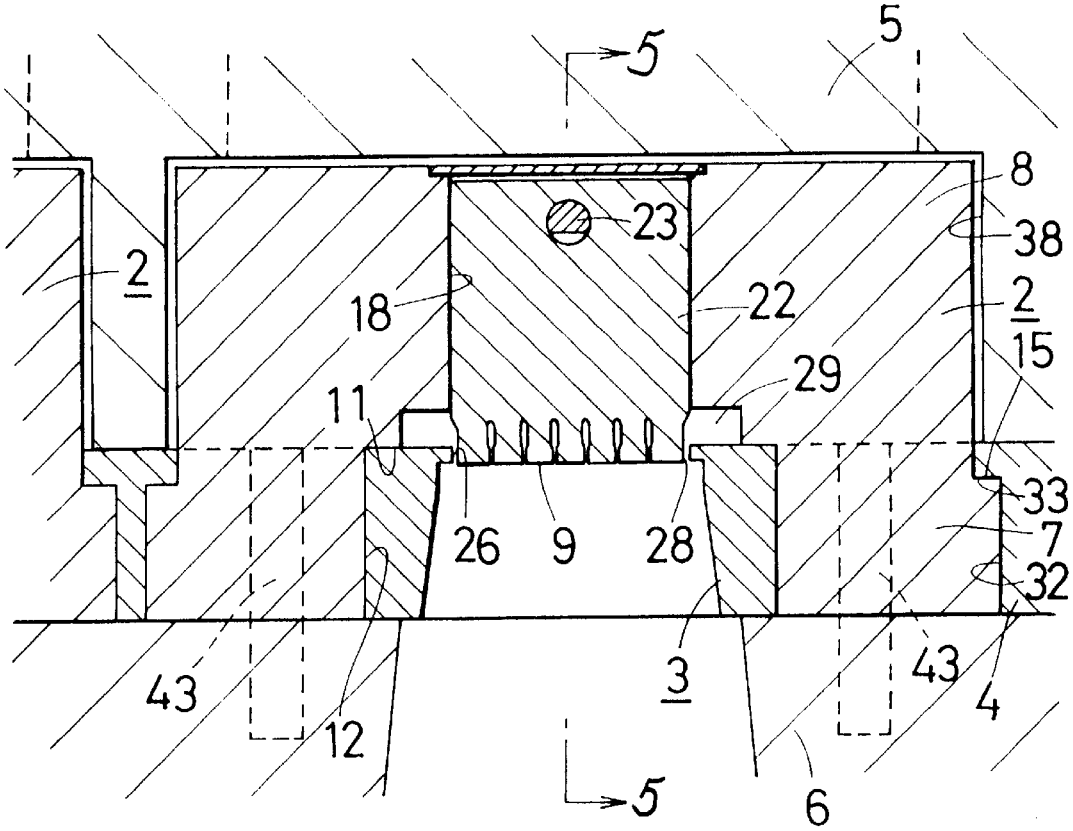
FIG. 8A is an enlarged cross section of a die assembly provided in a second embodiment and comprising a male die combined with a female die.
Figure 8B:
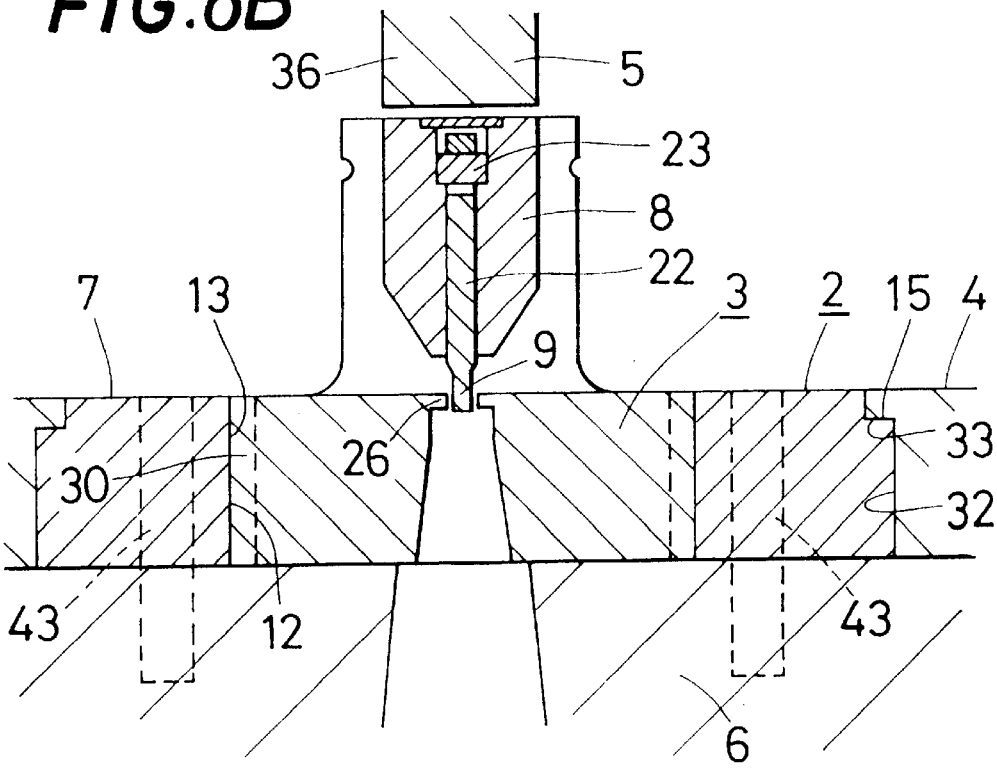
FIG. 8B is a cross section taken along the line 5—5 in FIG. 8A.

A die assembly provided in a second embodiment shown in FIGS. 8A and 8B comprises female dies 3 of a length equal to that of the annular bases 7 of male dies 2, and a sufficient forming cavity 28 is formed behind and proximate the rear face of each annular base. An annular step 33 formed in the aperture 32 of a die holder 4 is located nearer the rear face thereof, than that in the first embodiment.

Figure 9A:
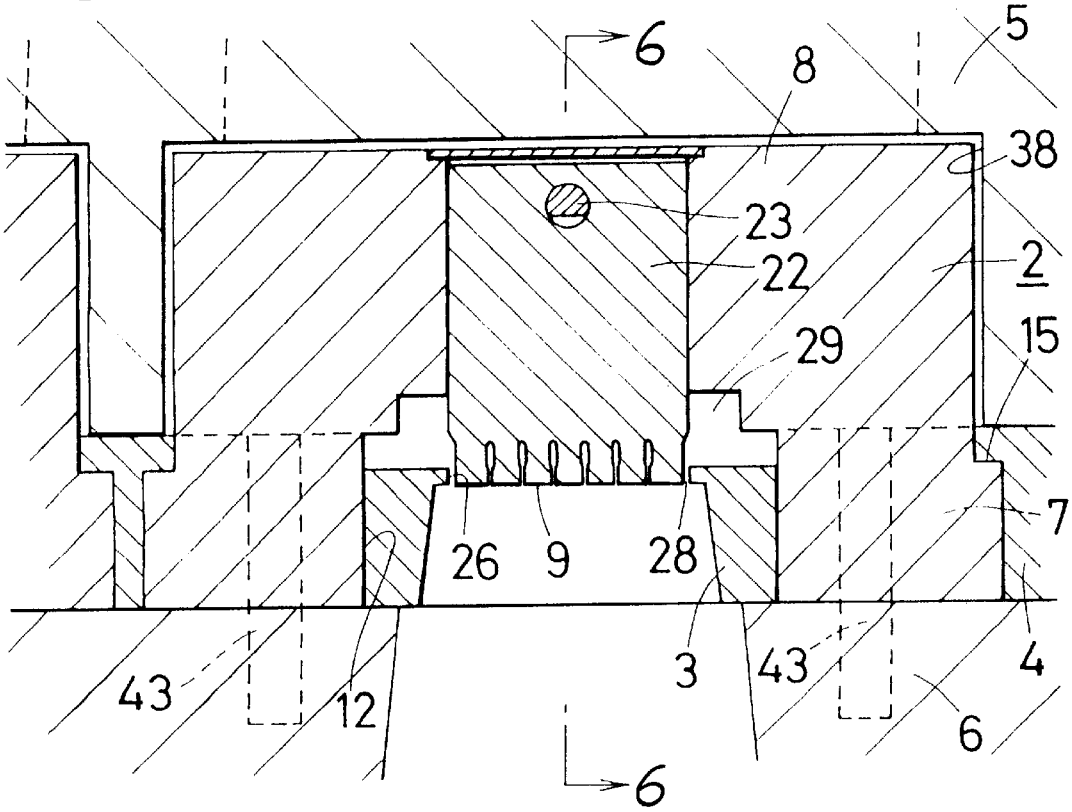
FIG. 9A is an enlarged cross section of a die assembly provided in a third embodiment and comprising a male die combined with a female die.
Figure 9B:
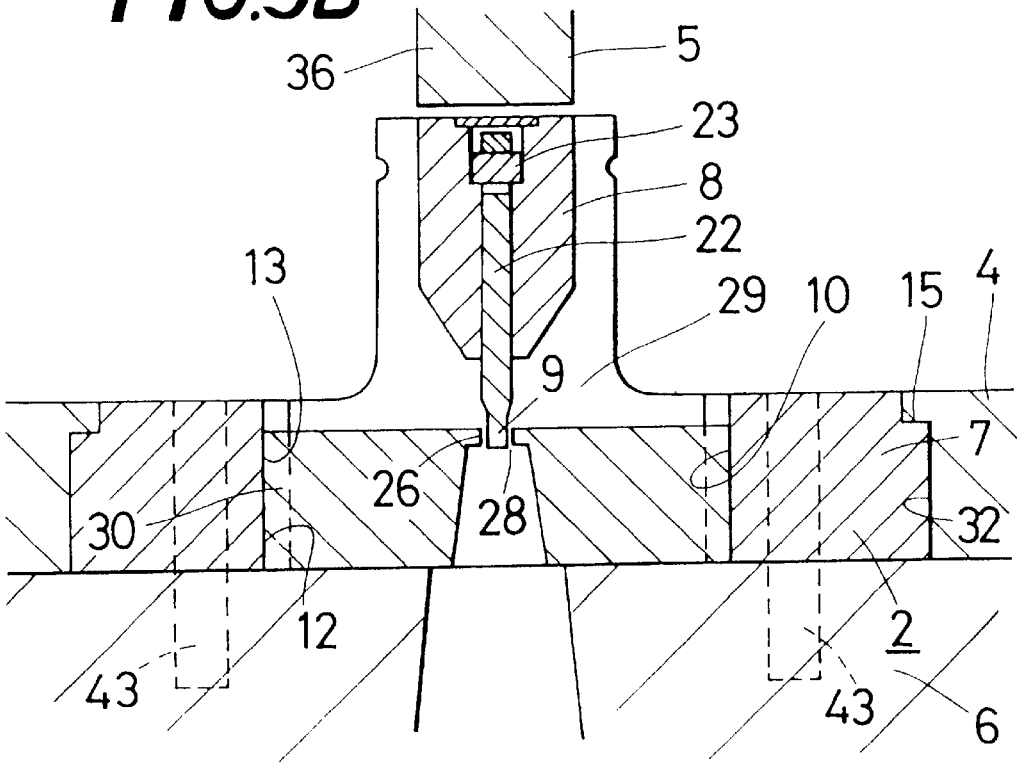
FIG. 9B is a cross section taken along the line 6—6 in FIG. 9A.

In another die assembly provided in a third embodiment shown in FIGS. 9A and 9B, the step-shaped shoulder 11 is dispensed with which the axial bore 10 in the first embodiment has. The forming slit 28 is however similarly disposed adjacent to the rear face of the annular base 7 and within the bore.

Figure 10A:
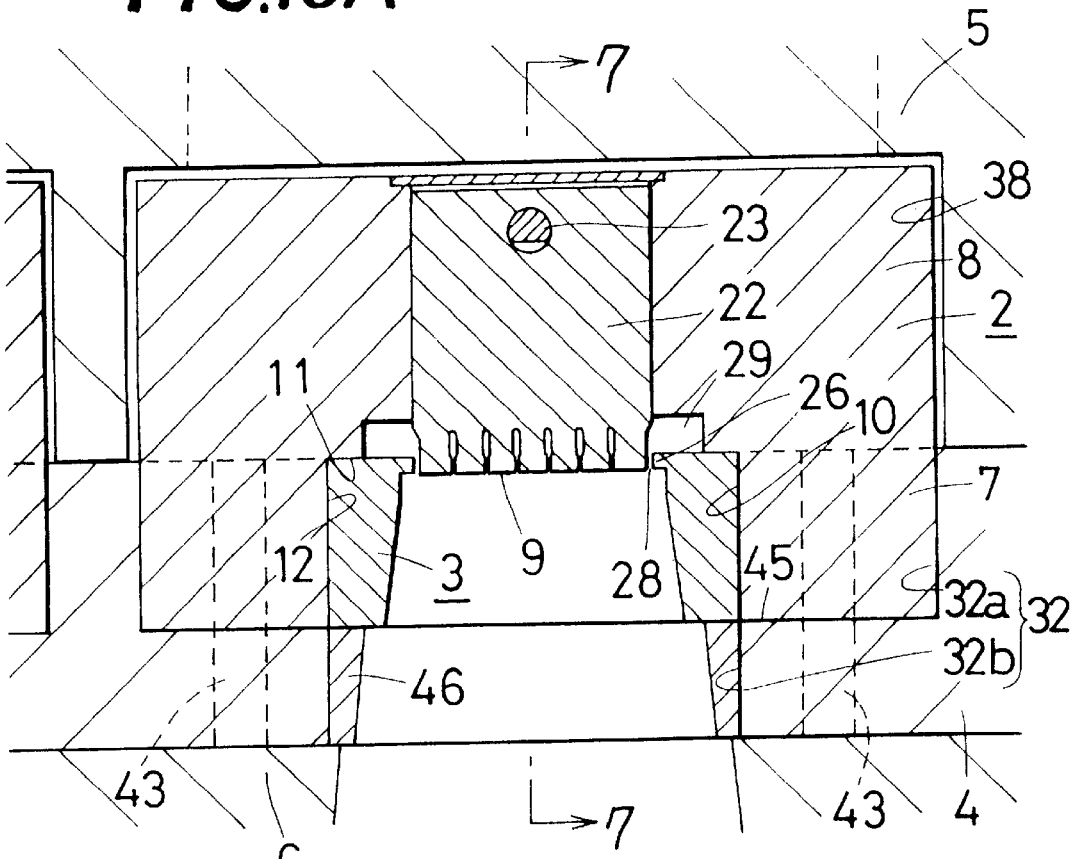
FIG. 10A is also an enlarged cross section of a die assembly provided in a fourth embodiment and comprising a male die combined with a female die.
Figure 10B:
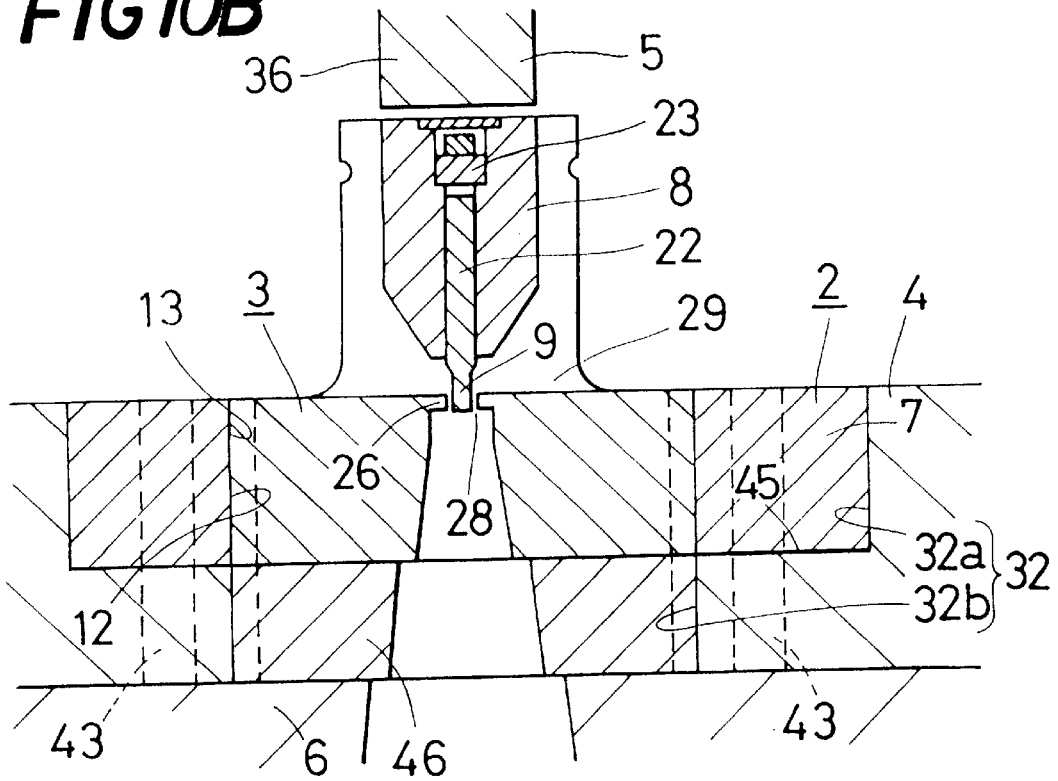
FIG. 10B is a cross section taken along the line 7—7 in FIG. 10A.

Still another die assembly provided in a fourth embodiment shown in FIGS. 10A and 10B comprises an annular step 45 formed in each die-holding aperture 32 of a die holder 4. This step 45 facing towards the male die 2 is composed of a large diameter region 32*a* and a small diameter region 32*b*. The male die 2 fits in the large diameter region 32*a* and is secured to the annular step 45 by means of knockout pins 43. A backup member 46 fitted in the small diameter region 32*b* and supporting the frontal face of the female die 3 is made of a hard material such as a hard metal or ceramics and shrinkage-fitted to the die holder 4 to be integral therewith.

Figure 11A:
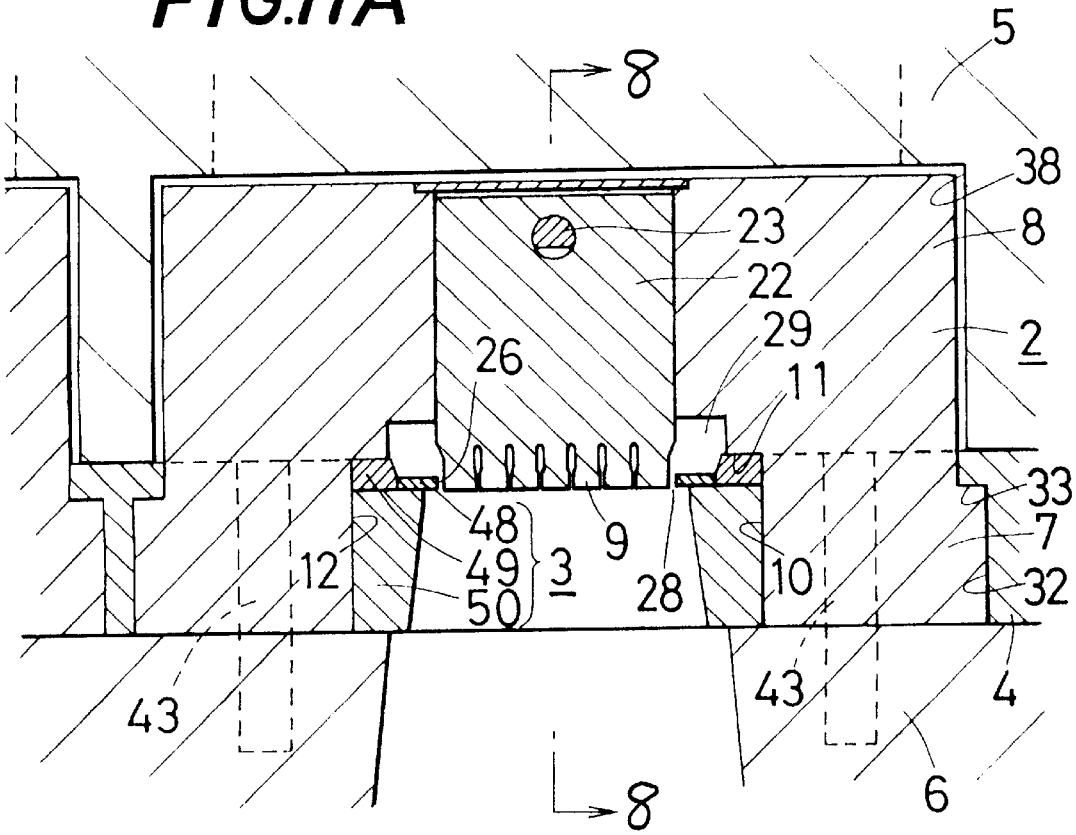
FIG. 11A is likewise an enlarged cross section of a die assembly provided in a fifth embodiment and comprising a male die combined with a female die.
Figure 11B:
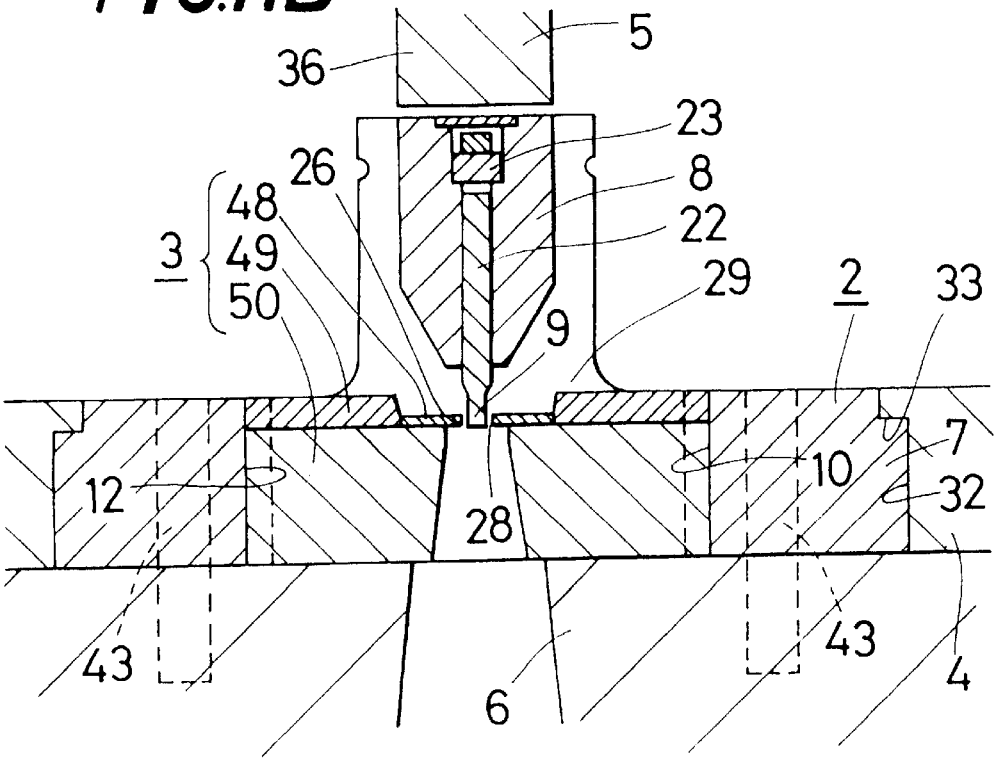
FIG. 11B is a cross section taken along the line 8—8 in FIG. 11A.

Each of female dies 3 in a further die assembly shown in FIGS. 11A and 11B is composed of a bearing tip 48, a flow regulator 49 and a back-up member 50. The regulator 49 cooperates with the member 50 to hold the tip.

Figure 12A:
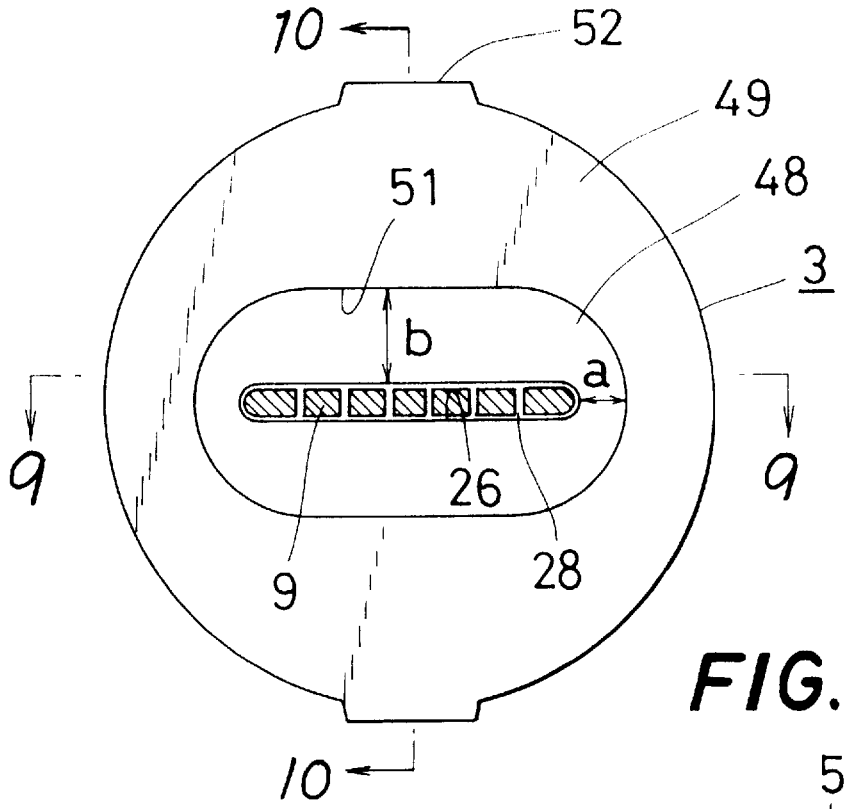
FIG. 12A is a rear elevation of the die assembly shown in FIGS. 11A and 11B, seen from an upstream side thereof.

The bearing tip 48 is a thin plate of a hard material such as a hard metal or ceramics, and is of a thickness corresponding to that of the bearing portion 26 preceding embodiments. A bearing portion 26 in the fifth embodiment is formed through and centrally of the bearing tip 48. This bearing portion 26 as an entrance region of the forming hole is of an elliptic shape defining the outer periphery of an extruded tube 1, and outer periphery of the bearing tip 48 is also elliptic as shown in FIG. 12A. A distance 'a' measured between those peripheries along the major axis is shorter than that 'b' measured along the minor axis.

Figure 12C:
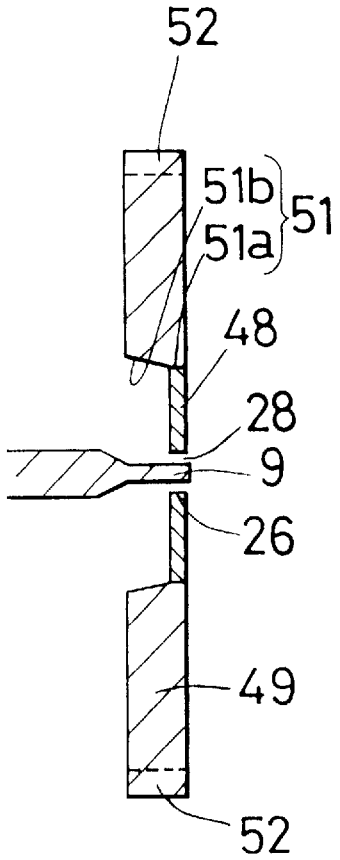
FIG. 12C is also a cross section taken along the line 10—10 in FIG. 12A.
Figure 12B:
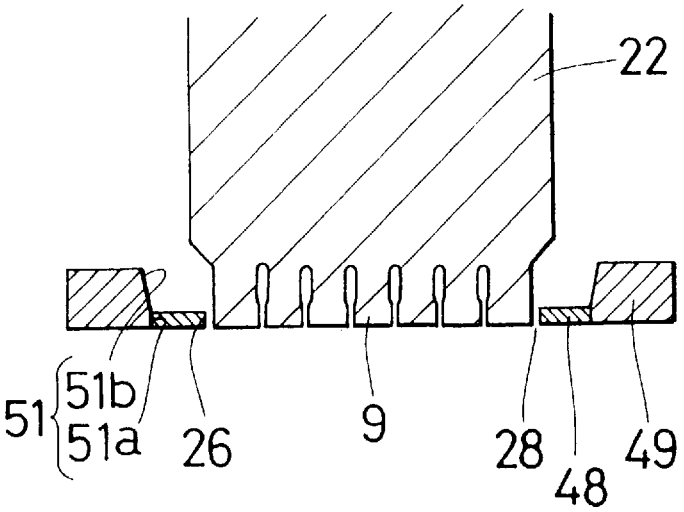
FIG. 12B is a cross section taken along the line 9—9 in FIG. 12A.

The flow regulator 49 also made of a hard material such as a hard metal or ceramics is a plate thicker than the bearing tip 48. A central opening 51 though this regulator is composed of a tip holding region 51*a* and a flow regulating region 51*b* disposed rearwardly thereof as shown in FIGS. 12B and 12C. The former region 51*a* is of a shape and size coincident with the outer periphery of the bearing tip 48, which tightly fits in this region 51*a*. The latter region 51*b* is tapered to increase inner diameter towards an upstream side of the regulator. A basal end portion of the comb-shaped forming lug 9 is surrounded by the flow regulating region 51*b*, so that a space for flowing the material and defined between the left-hand or right-hand corners (in the drawings) of the peripheries of opening 51 and bearing tip 26 is narrower than another space defined between the upper or lower sides (in the drawings) of said peripheries. Keys 52 serve to set this regulator 51 at its correct position within the female die receiving recess 12 formed in the male die annular base 7.

The back-up member 50 also made of a hard material such as a hard metal or ceramics and fitted in the recess 12 is located therein forwardly of the bearing tip 48 and the flow regulator 49 so as to support them during extrusion process. The regulator 49 and the back-up member 50 are shrinkage-fitted in said recess of the male die 2.

In the fifth embodiment, the composite female die 3 having the bearing tip 48 used as the bearing portion 26 and of a thickness corresponding thereto, so that when the bearing portion becomes abraded, only the tip 48 need be replaced with a new one. Therefore, material cost of renewing the female dies will be reduced.

The forming slit 28 is disposed near the rear face of the annular base 7, the rearwardly projecting bridge 8 holds the forming lug 9 integral with the core 22 which is removable rearwardly from said bridge, and the essential part of the female die 3 is such a thin bearing tip 48 in the fifth embodiment. Therefore, it may be possible to remove the bearing tip 48 by rearwardly pushing it by an ejecting tool when the bearing portion 26 is abraded. Such a thin tip 48 will squeeze outwardly between the annular base 7 and the bridge 8. It may be possible to replace only the worn tip 48, without dismounting the regulator 49 and the back-up member 50, thus facilitating the maintenance work.

As mentioned above, the distance 'a' between the periphery of tip 48 surrounded by the regulator 49 and the periphery of bearing portion 26, measured along the major axis, is shorter than that 'b' measured along the minor axis. The space for flowing the material and defined between the left-hand or right-hand corners (in the drawings) of the peripheries of opening 51 and bearing tip 26 is narrower than another space defined between the upper or lower sides (in the drawings) of said peripheries. Therefore, the material to be extruded can flow smoothly in between teeth of the comb-shaped forming lug 9. Outer ones of the teeth will not be subjected to a centripetal pressure of the flowing material, so that they will be protected well from distortion and/or breakage.

Figure 13A:
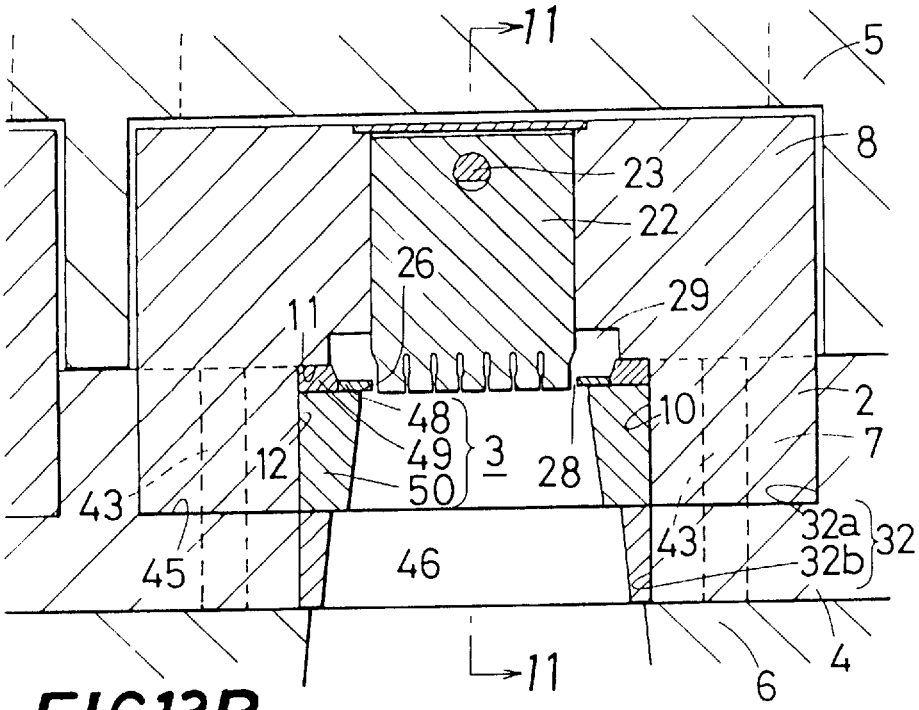
FIG. 13A is an enlarged cross section of a die assembly provided in a sixth embodiment and comprising a male die combined with a female die.
Figure 13B:
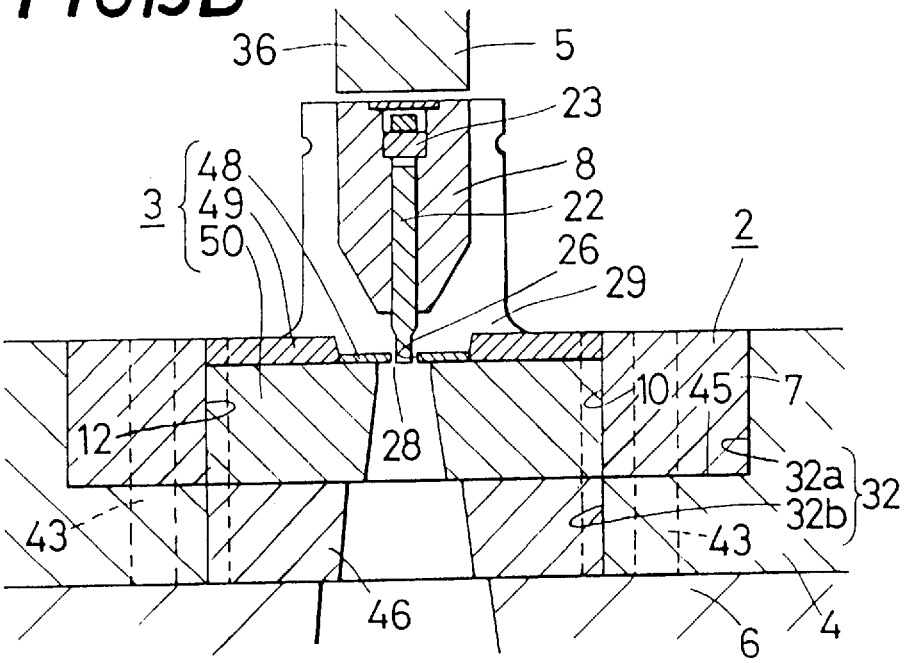
FIG. 13B is a cross section taken along the line 11—11 in FIG. 13A.

FIGS. 13A and 13B show a sixth embodiment wherein, similarly to the fifth embodiment, each female die 3 is composed of a bearing tip 18, a flow regulator 49 and a back-up member 50. Similarly to the fourth embodiment, an annular step 45 is formed in each die-holding aperture 32 of a die holder 4. This step 45 facing towards the male die 2 is composed of a large diameter region 32*a* and a small diameter region 32*b*. The male die 2 fits in the large diameter region 32*a* and is secured to the annular step 45 by means of knockout pins 43. A backup member 46 fitted in the small diameter region 32*b* and supporting the frontal face of the female die 3.

In summary, the die assembly provided by the present invention is characterized in that the female die is tightly fitted in the male die is such a manner that a distance between the forming slit and their portions in engagement with each other is noticeably decreased. As a result, any distortion that might appear in the male and/or female die due to extrusion pressure will not cause any intolerable differential displacement between the forming lug and the forming hole. Thus, a highly accurate alignment of the forming lug with the hole will be maintained during the extrusion process, so that a hollow article of high dimensional precision free of any unevenness in wall thickness can now be produced.

The bridge protrudes rearwardly from the rear face of the annular base, and the forming slit defined by and between the male and female dies is located at or proximate said rear face of the annular base. Thus, prior art port-holes are dispensed with to reduce the area of this die assembly in contact with the material that is being extruded. Consequently, frictional resistance is also reduced to decrease the extrusion pressure and to improve the productivity of the hollow articles.

A plurality of male dies are set and held in the die holder, and the female dies are respectively fitted in the respective annular bases of male dies so that a plurality of hollow articles are extruded at the same time. Although a noticeable misalignment of each male die with the corresponding female die has been likely to occur in the prior art large-sized die assembly is now avoided. The high accuracy in alignment of the male dies with the female dies continues during the extrusion process carried out using the die assembly of the present invention, thereby enabling simultaneous extrusion of the hollow articles of a high dimensional accuracy free from any intolerable unevenness in wall thickness.

What is claimed is:

1. A die assembly for mounting in a die holder having an annular through-opening, said die assembly being operative for extruding hollow articles from an extrudable natural and comprising:

a male die member having an annular base containing oppositely disposed first and second faces and an annular periphery for fitted reception in said die holder through-opening, an axially disposed cylindrical recess formed in said first face of said annular base concentric with the periphery thereof and having a bottom axially spaced from said first face at a location short of said second face, an axial bore extending from said recess bottom through said second face of said annular base, said bore being of a diameter smaller than the diameter of said recess to cooperate with the bottom thereof to form an annular shoulder, a female die member having a generally cylindrical body fittedly received in said cylindrical recess of said annular base, said female die member containing an axial through-opening defining axially aligned concentric bearing and relief portions and having a bottom surface in engagement with said annular shoulder in said annular base of said male die member, a circumferentially spaced pair of keys formed on the body of said female die member engaging cooperating slots formed in said recess to restrict relative radial movement between said female die member and said male die member, a bridge integrally formed on said annular base of said male die member and extending diametrally across said axial bore between a pair of oppositely spaced bridge supports that project from said second face of said annular base to locate said bridge in axially spaced relation with respect to said annular base second face, a forming lug extending from said bridge through said axial bore to dispose a forward end of said lug with respect to said bearing portion of said female die for extrusion of said hollow articles, and means in said bridge for releasably attaching said forming lug.

2. The die assembly as defined in claim 1 wherein said bridge contains a substantially centrally disposed aperture receiving a rear end of said forming lug, said aperture being sized to permit removal and installation of said forming lug from a rearward direction of said bridge, and means for securing said forming lug within said aperture.

3. The die assembly as defined in claim 1 wherein said female die comprises a tip holder and a bearing tip attached thereto, said bearing tip being formed of a plate having a thickness corresponding substantially to that of said bearing region, and a backing member tightly fit in said cylindrical recess in said annular base of said male die member in axially spaced, abutting relation to said tip holder and said bearing tip for securing said tipholder and said tip in assembled relation within said recess.

4. A die assembly as defined in claim 1 wherein said forward end of said forming lug and said female die bearing portion cooperate to form a forming slit located substantially at said second face of said annular base.

5. A die assembly as defined in claim 3, wherein said tip holder comprises a flow regulating block having a flow constricting surface adjacent said bearing tip.

6. A die assembly as defined in claim 3, wherein said first face of said annular base of said male die member is substantially flush with a surface of said female die member such that said female die member fits entirely within said annular base of said male die member.

7. A die assembly as defined in claim 1 wherein said keys on said female die member and said slots in said recess of said annular base each have rectangularly arranged sides.

* * * * *